United States Patent [19]

Yen

[11] Patent Number: 5,009,004

[45] Date of Patent: Apr. 23, 1991

[54] FOLDABLE RAZOR ASSEMBLY

[76] Inventor: Lung-Wu Yen, No. 28, Ming Cheng Street, San Ming Area, Kao Hsiung City, Taiwan

[21] Appl. No.: 562,557

[22] Filed: Aug. 2, 1990

[51] Int. Cl.[5] ..... B26B 21/00; B26B 21/14

[52] U.S. Cl. ..... 30/47; 30/86

[58] Field of Search ..... 30/41, 47, 86, 87, 89; 206/228, 38, 349

[56] References Cited

U.S. PATENT DOCUMENTS 2,053,550 9/1936 Chodaczok ..... 30/86
2,512,953 6/1950 Maduff et al. ..... 30/47
2,575,639 11/1951 Bennett ..... 30/47
2,725,626 12/1955 Baker ..... 30/86
4,332,321 6/1982 Wratschko ..... 30/47

*Primary Examiner*—Douglas D. Watts
*Assistant Examiner*—Paul M. Heyrana, Sr.
*Attorney, Agent, or Firm*—Morton J. Rosenberg; David I. Klein

[57] ABSTRACT

A foldable razor assembly essentially comprising a blade support, a first mounting element and a second mounting element which mounted to each other, an inner cylinder, an outer cylinder and a cylinder recess to form the handle for the razor assembly. The blade, support of the assembly can be extended for ready used or retracted for carrying by rotating of the handle.

3 Claims, 5 Drawing Sheets

FOLDABLE RAZOR ASSEMBLY

BACKGROUND OF THE INVENTION

In conventional razor assembly, the blade support and the handle means are fixed and rigid and formed into a T-shaped frame. That is, the structure of this assembly cannot be folded or retracted into a compact assembly. As a result, the large volume of the razor assembly is inconvenient to be portable. In some similar type of razor assembly, a plastic cap is provided to protect the blade from accidental touching. However, the cap and the blade are easily dislocated from the razor assembly. Therefore, it must be paid additional attention while carrying along this razor assembly.

SUMMARY OF THE INVENTION

It is therefore an object of the invention to provide a foldable razor assembly, in which the structure is simple and which permits folding while not in use.

It is another object of the present invention to provide a foldable razor assembly in which the handle of the razor assembly can be rotated at an angle of 90° so as to fold the blade into a safe and secure position.

It is still another object of the present invention to provide a foldable razor assembly in which the blade can be stored within the handle of the razor assembly.

Yet still another object of the present invention to provide a foldable razor assembly which is convenient and safe to be portable.

Yet still another object of the present invention is to provide a foldable razor assembly in which a plurality of compartment is formed at the end of the handle of the razor assembly, which provides a storage for blades, mirror, or small articles.

BRIEF DESCRIPTION OF THE DRAWING

The invention will now be further described in terms of a non-limitative exemplary embodiment thereof and with reference to the accompanying drawings, in which.

DETAILED DESCRIPTION OF THE INVENTION

Figure 1:
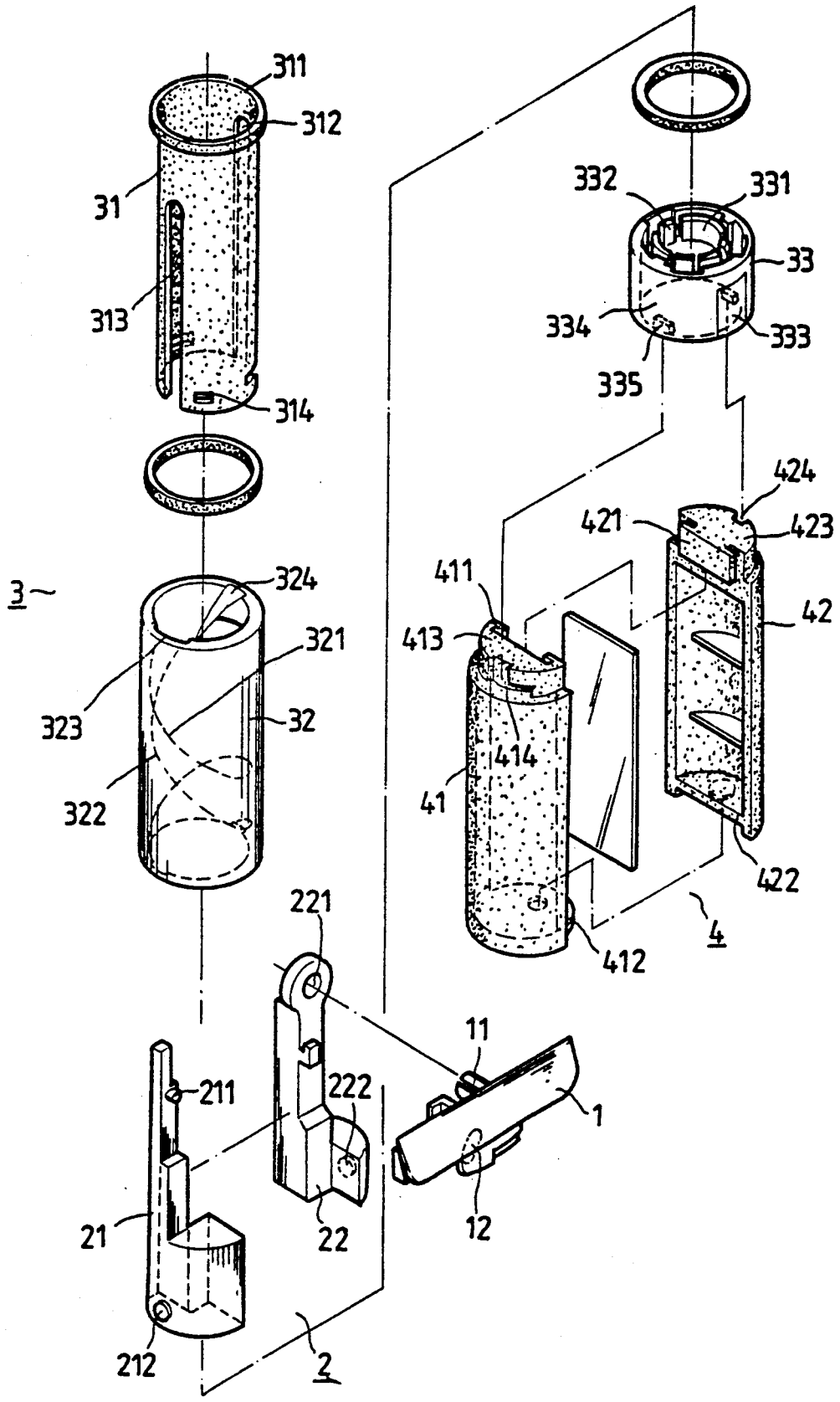
FIG. 1 is an exploded diagram of all the parts of the razor assembly in accordance with the present invention.

Referring to the drawings, in particular to FIG. 1, which illustrates the present invention essentially comprises a blade support (1), shaft means (2), handle means (3) and a storage means (4).

The blade support (1) is substantially a horizontal plate which is adapted for the engagement of a blade at the front surface of the plate. The rear portion of the blade support (1) is provided with a protruded element

(11) and a guide slot (12) for the combination with the shaft means (2).

The shaft means (2) comprises two blades mounting elements (21) (22), i.e. a first mounting element (21) and a second mounting element (22). A pimple (211) is provided at the step-like top section of the first mounting element (21) while an aperture (221) is provided at the top section of the second mounting element (22). The aperture (221) provides the mounting of the blade support (1) by the protruded element (11). The first mounting element (21) and the second mounting element (22) can be engaged with each other. After these two elements (21) (22) are combined with each others, the bottom of the shaft means (2) forms into a cylindrical shape which can later be kept within the handle means (3). Pimples (212) (222) which are individually provided to the mounting elements (21) and (22) at the lower section thereof.

Figure 2:
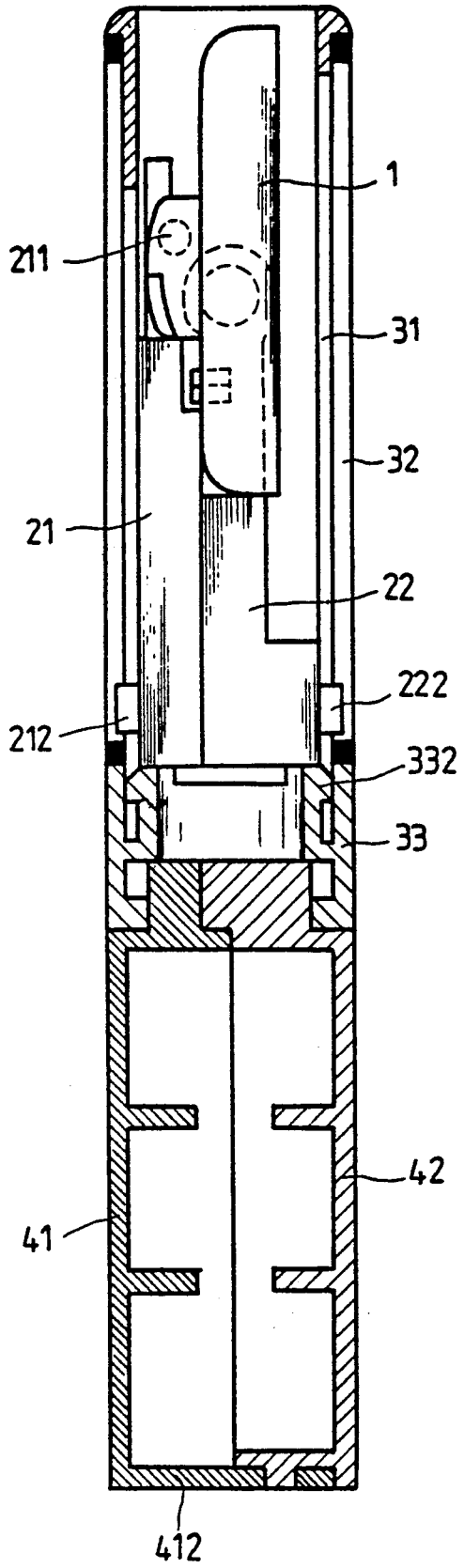
FIG. 2 is an elevational view of the razor assembly in accordance with the present invention.

The handle means (3) comprises an inner cylinder (31), an outer cylinder (32) and a cylinder recess (33). The inner cylinder (31) is hollow which is adapted for the accommodation of the shaft means (2). The top end of the inner cylinder (31) is provided with a ring of circular edge (311). Two vertical slots (312) (313), a long vertical slot (312) and a short vertical slot (313) corresponding to each others, are provided at the surface of the inner cylinder (31). At the lower section of the inner cylinder (31), near to the edge of the opened-end thereof, is provided with fixing aperture (314) for fixing purpose. The outer cylinder (32) has a hollow center which is adapted to the insertion and accommodation of the inner cylinder (31). The internal surface of the outer cylinder (32) is provided with a high spiral slot (321) and a low sprial slot (322). Referring to FIG. 2, the distance difference between the height of the two spiral slots (321) (322) is equal to the difference between the height of the two vertical slots (312) (313). At the top end of the high spiral slot (321), a short horizontal channel (324) is provided along the top opened edge of the outer cylinder (32), and similarly, a long horizontal channel (323) is provided along the top opened edge of the outer cylinder (32). The distance difference between the two channels (323) (324) is exactly equal to the tangent of the difference in height of the spiral slots (322) (321). The cylinder recess (33) is a short cylindrical shape. The inner of the top section thereof is provided with a vertical arch-shaped structure (321). A depression formed by these structures (331) and the interior wall of the cylinder recess (33) provides the insertion to the inner cylinder (31) at the lower opened end thereof. The external wall of the arch-shaped structure (331) is provided with several fixing protrusion (332) for the fixing of inner cylinder (31) at the fixing aperture (314) thereof. At the exterior of the cylinder recess (33), a cut vertical face (333) is provided. When rotating the external cylinder (32), the cylinder recess (33) is held at the cut vertical face (333), so that the shaft means (2) can be either extended or retracted. A circular depression (334) is provided at the bottom of the cylinder recess (33) and two protrusions (335) are provided along the inner edge of the depression (334), so that the storage means (4) can be mounted thereto.

The storage means (4) comprises two semi cylindrical elements (41) (42) of more or less structure. By means of the engaging elements (411) (412) mounted on top thereof, and the bottom plates (412) (422), respectively mounted to the elements (41) (42), the two elements (41) (42) can be combined to form a cylindrical element having an external diameter substantially equal to that of the outer cylinder (32). Two platforms (413) (423) respectively mounted on top of the semi-cylindrical elements (41) (42) are respectively provided with an L-shaped engaging slots (414) (424). When the semi-cylindrical elements (41) (42) are mounted to the cylinder recess (33) (at the bottom slot (334)) by the platform (413) (423), the engaging slots (414) (424) engage with the protrusion (335) of the cylinder recess (33). The interior of the semi-cylindrical elements (41) (42) are provided with compartments which can be used to store small articles such as blades, mirror, etc.

For the combination of the blade support (1) with the shaft means (2), the protruded element (11) of the blade support (1) is inserted into the aperture (221) at the top end of the second mounting element (22), and the two mounting elements (21) (22) are then combined with each other to form a cylindrical body. The pimple (211) at the top section of the first mounting element (21) is inserted into the guide slot (12) of the blade support (1), and the blade support (1) can be rotated to an angle of 90 degree, i.e. in a retracted position. The inner cylinder (31) is inserted into the interior of the outer cylinder (32) such that the lower opened end of the high vertical slot (312) and the lower opened end of the high spiral slot (312) are aligned with each other, and the lower opening of the low vertical slot (313) is in alignment with the lower opening of the low spiral slot (322), and after that the cylinder recess (33) is moved upward such that the bottom end of the inner cylinder (31) is exactly fixed into the depression formed between the cylinder recess (33) and the arch-shape structure (331). By means of the fixing protrusion (332) of the arch-shape structure (331), the cylinder recess (33) is engaged onto the fixing aperture (314) of the inner cylinder (31). The two semi-cylindrical elements (41) (42) are combined such that the protruded element (411) (421) and the bottom edges (412) (422) fixed to each other to form a storage means (4). Move the storage means (4) upward to engage within the cylinder recess (33). By means of the protrusion (335), which can be moved along the engaging slots (414) (424) and be engaged with the storage means (4).

FIG. 2 illustrates the elevational view of the present invention. The blade support (1) is at 90° and folded and stored within the shaft means (2). This embodiment provides a safer and portable razor assembly.

Figure 3:
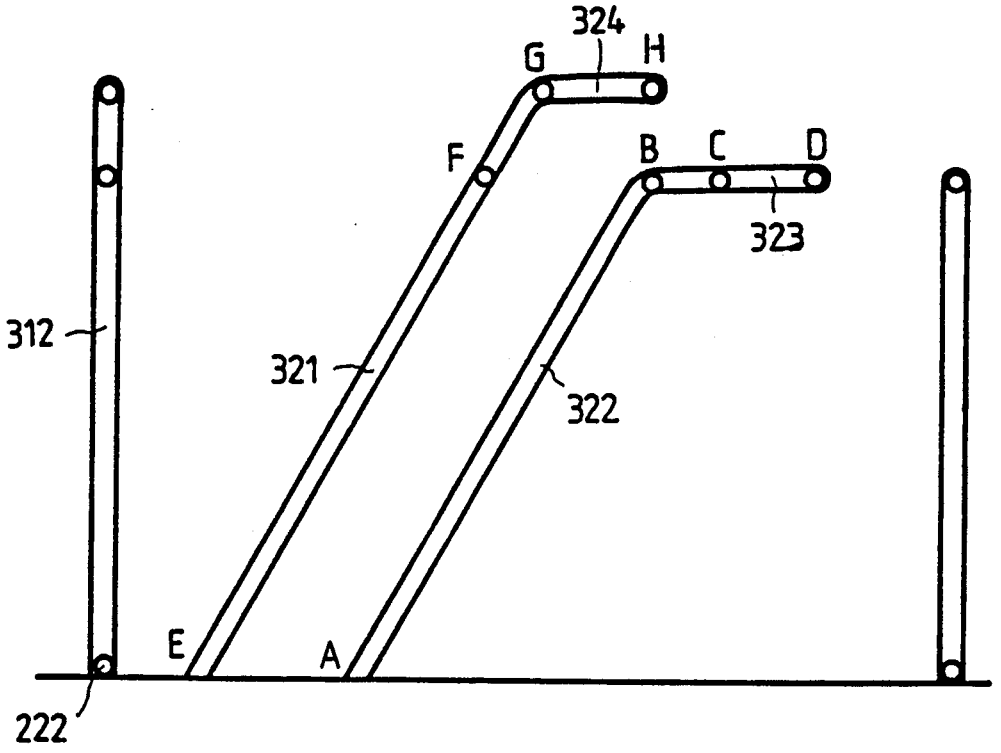
FIG. 3 illustrates the relative position of the exterior spiral slot and the interior spiral slot of the razor assembly in accordance with the present invention.
Figure 4:
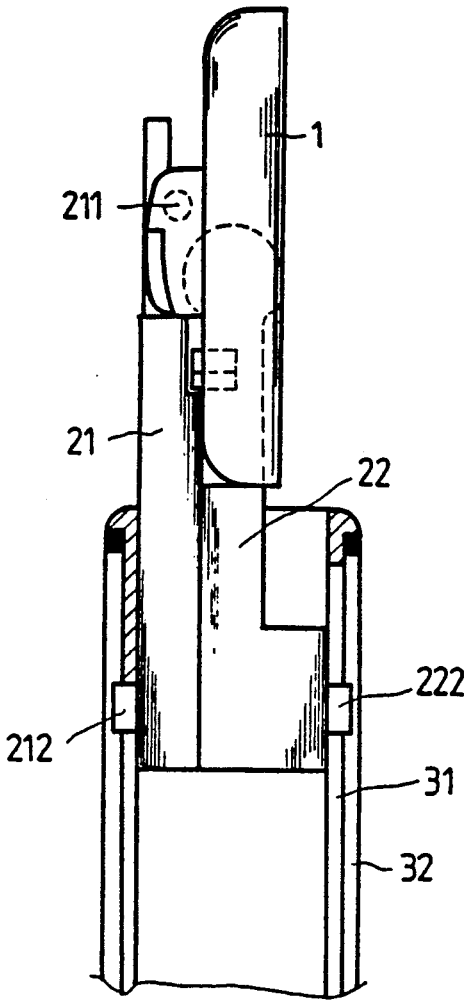
FIG. 4 illustrates the extended position of the shaft of the blade from the exterior end of the handle in accordance with the present invention.
Figure 5:
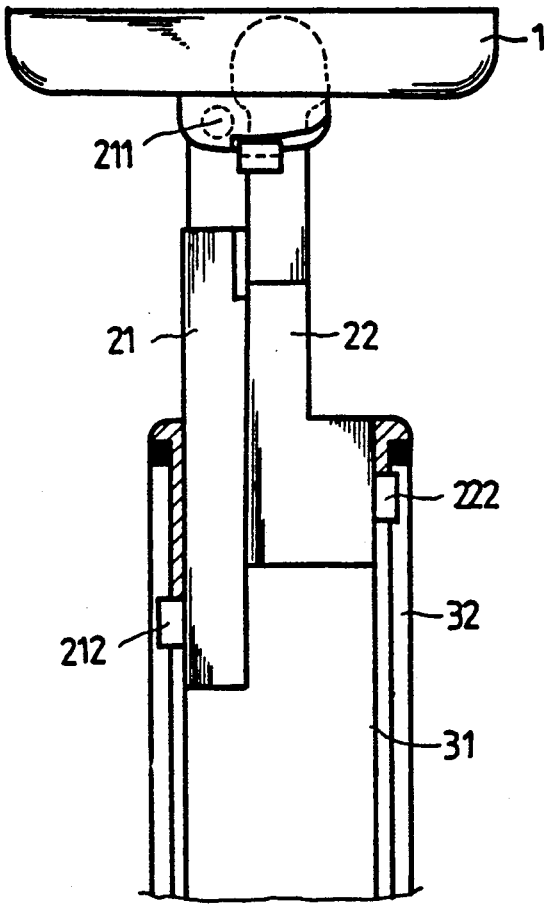
FIG. 5 illustrates the position at which the blade has rotated to a perpendicular position with respect to the shaft of the razor assembly in accordance with the present invention.

When the razor is to be used, one of the hand holds the cylinder recess (33) at the face (333) tight and the other hand rotates the outer cylinder (32). By means of the high spiral slot (321) and the low spiral slot (322), the pimples (222) (212) of the mounting elements (22) (21) move along the high vertical slot (312) and the low vertical slot (313). The path of moving is shown in FIG. 3 (E–F1 and A–B). When the pimples (222) (212) move upward to the position of F, B of FIG. 3, the first mounting element (21) is at the fixed position. At this moment, the blade support (1) has totally extended outward of the handle means (3), which is shown in FIG. 4. When the outer cylinder (32) is continuously rotated, the pimple (212) of the first mounting element (21) does not move upward due to the restriction of the low vertical slot (312), and therefore, it moves within the horizontal slot (323), which is shown as B–C of FIG. 3. At this moment, the height of the first mounting element (21) is fixed. The pimple (222) at the lower section of the second mounting element (22) continuously moves upward to the vertical slot (312) (as shown as F–G in FIG. 3). This movement is achieved by that the second mounting element (22) pushes the blade support (1) such that the vertical position of the blade support (1) rotates to a horizontal extended position, which is shown in FIG. 5. At this moment, rotating the outer cylinder (32), the pimples (212) or (222) will not move upward but will move along the horizontal slot (323) and (324) respectively, i.e. move along C–D and G–H to an engaged position, at which the razor assembly can be used.

In order to fold the blade support (1), rotates the external cylinder (32) in a reverse direction. That is, the outer cylinder (32) moves along the path in the opposite direction so that the blade support (1) rotates at an angle of 90° and then retracted within the cylinder shape storage means (4).

Basically, whether the storage means (4) is mounted or not will not affect the retraction or extension of the blade support (1), shaft means (4) and the handle means (3). The storage means (4) is an additional means mounted to the bottom end of the shaft means (2) and functioned as a storage for blades and mirror.

As various possible embodiments might be made of the above invention, and as various modifications might be made in the embodiment above set forth, it is to be understood that all matter herein described or shown in the accompanying drawings is to be interpreted as illustrative and not in a limiting sense. Thus it will be appreciated that the drawings are exemplary of a preferred embodiment of the invention.

We claim:

1. A foldable razor assembly essentially comprising a blade support (1) substantially T-shaped having a horizontal plate for installing a blade, the rear surface thereof being provided with a protruding element (11) and a guide slot (12) for engagement;

a shaft means (2) consisting of a first mounting element (21) and a second mounting element (22) which are mounted to each other, a pimple (212) being provided at the top end of the first mounting element (21) for engagement with the guide slot (12) of said blade support (1), an aperture (221) being provided at the top end of the second mounting element (22) for the engagement with the protruded element (11) of the blade support (1), the bottom end of the shaft means (2) being circular and used for the engagement with a handle means (3), a pair of pimples (212) (222) being provided oppositely along the lower end of said shaft means (3);

said handle means (3) consisting of an inner cylinder (31), an outer cylinder (32) and a cylinder recess (33), said inner cylinder (31) having a hollow center which can be used to adapt said shaft means (2), the upper end thereof being provided with a round edge (311), along the surface of said inner cylinder (31), a low vertical slot (313) and a high vertical slot (312) in opposite position being provided, at the bottom end of said inner cylinder (31), a plurality of fixing holes (314) being provided for engagement, the outer cylinder (32) having a hollow center which is be used to adapt said inner cylinder (31), the interior wall of the external cylinder (32) being provided with a high spiral slot (321) and a low spiral slot (322), at the top end of said high spiral slot (321), a short horizontal slot (323) being provided and a long horizontal slot (324) being provided at the top end of said low spiral slot (322), the difference in distance between the two horizontal slots (324) (323) being equal to the tangent of the difference in distance between the height of the two spiral slots (321) (322), the cylinder recess (33) being mounted at the bottom of said handle means (3) with arch shaped structure (331) mounted along the top section of said cylinder recess (33), a depression being formed by the arch shape structure (331) and the interior wall of said cylinder recess (33) for the insertion of said inner cylinder (31), the external wall of the arch-shaped structure being provided with a plurality of fixing protrusions (332) for engagement.

2. The razor assembly as set forth in claim 1, wherein the difference in distance between the height of the two spiral slots (321) (322) is equal to the difference in distance between the two vertical slots (312) (313) of the inner cylinder (31) such that the pimples of the mounting element respectively pass through the low vertical slot and high vertical slot and extended to the low and high spiral slots of the external cylinder.

3. The razor assembly as set forth in claim 1, further comprising a storage means comprising two semi-cylindrical elements, by means of the engaging elements (411, 424) mounted on top thereof and bottom plates (412, 422) mounted at the bottom thereof, said two elements being combined to form a cylindrical element having an external diameter substantially equal to the external cylinder, two platforms mounted on top of said semi-cylindrical element being respectively provided with a L-shaped engaging slot, the engaging slots being engaged with the protrusion of said cylinder recess, the interior of the storage means being hollow which can be used for storage.

* * * * *